US008101331B2

(12) United States Patent
Fan et al.

(10) Patent No.: US 8,101,331 B2
(45) Date of Patent: Jan. 24, 2012

(54) METHOD AND APPARATUS OF RAPID CONTINUOUS PROCESS TO PRODUCE CHEMICAL TONER AND NANO-COMPOSITE PARTICLES

(75) Inventors: Fa-Gung Fan, Fairport, NY (US); Steven M. Malachowski, East Rochester, NY (US); Yuhua Tong, Webster, NY (US); Chieh-Min Cheng, Rochester, NY (US); Pinyen Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/641,565

(22) Filed: Dec. 18, 2009

(65) Prior Publication Data

US 2011/0151375 A1 Jun. 23, 2011

(51) Int. Cl.
*G03G 5/00* (2006.01)
*B28B 17/00* (2006.01)

(52) U.S. Cl. ..... 430/137.2; 430/118.8; 425/6

(58) Field of Classification Search ... 425/6; 430/118.8, 430/137.2

See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,935,326 | A | 6/1990 | Creatura et al. |
| 4,937,166 | A | 6/1990 | Creatura et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 5,346,797 | A | 9/1994 | Kmiecik-Lawrynowicz et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,063,827 | A | 5/2000 | Sacripante et al. |
| 6,214,507 | B1 | 4/2001 | Sokol et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,452,646 | B2 | 11/2008 | Hu et al. |
| 2005/0154088 | A1 * | 7/2005 | Miura et al. ..... 523/223 |
| 2006/0222991 | A1 | 10/2006 | Sacripante et al. |

* cited by examiner

*Primary Examiner* — Thorl Chea

(57) ABSTRACT

A process for making particles is provided. In embodiments, a suitable process includes a mixing tank for mixing a plurality of particles dispersed within a liquid media and a vane unit for applying a swirling effect to the plurality of droplets received from the mixing tank through a spray nozzle. The vane unit is in operable communication with a spray nozzle for launching a plurality of droplets, the plurality of droplets including different combinations of the plurality of particles. The process further includes a plurality of outlet ports, where each of a first set of outlet ports includes a filter and of the other outlet port is filterless.

8 Claims, 2 Drawing Sheets

METHOD AND APPARATUS OF RAPID CONTINUOUS PROCESS TO PRODUCE CHEMICAL TONER AND NANO-COMPOSITE PARTICLES

CROSS REFERENCE TO RELATED APPLICATIONS

The present application relates to co-pending U.S. patent application Ser. No. 12/641,539 filed Dec. 18, 2009, entitled Method And Apparatus Of Rapid Continuous Drop Formation Process To Produce Chemical Toner And Nano-Composite Particles, the disclosure of which is hereby incorporated by reference in its entirety.

BACKGROUND

The present disclosure relates to processes for producing toners suitable for electrophotographic apparatuses.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

EA toner processes include coagulating a combination of emulsions, i.e., emulsions including a latex, wax, pigment, and the like, with a flocculent such as polyaluminum chloride and/or aluminum sulfate, to generate a slurry of primary aggregates which then undergoes a controlled aggregation process. The solid content of this primary slurry dictates the overall throughput of the EA toner process. The solids content of the primary slurry is conventionally between about 11% and about 14%. While an even higher solids content may be desirable, it may be difficult to achieve due to high viscosity of the emulsions and poor mixing, which may lead to the formation of unacceptable primary aggregates (high coarse particle content).

Experimental data has shown that the aggregation step generally includes two stages. In the first stage, the primaries come together to form small clusters about 1-3 microns in size (i.e., aggregates). This stage is relatively fast (i.e., the process typically completes in about 5 minutes). For the second stage of aggregation, the so-formed 1-3 micron sized clusters further aggregate into 5-8 micron toner sized particles. The process speed of this second stage is relatively slow. In the past, there have been various theories/hypotheses for the explanation of this process. Whatever the reason, the long process time increases the cost of manufacturing and limits the rate of throughput of a toner plant.

Consequently, improved methods for producing toners, which reduce the number of stages and materials, remain desirable. Such processes may reduce production costs for such toners and may be environmentally friendly.

SUMMARY

The present disclosure provides processes for making toner particles. In embodiments, a process of the present disclosure includes a system for chemical toner production including a mixing tank for mixing a plurality of particles dispersed within a liquid media, a vane unit for applying a swirling effect to the plurality of particles in the mixing tank, a spray nozzle in operable communication with the vane unit for launching a plurality of droplets, the plurality of droplets composed of different combinations of the plurality of particles, and three outlet ports. The first outlet port is circular and has a filter. The second outlet port is annular and does not have a filter. The third outlet port is annular and has a filter. The swirling effect generated by the vane unit causes the plurality of droplets to be received by the three outlet ports in different sizes.

In other embodiments a process of the present disclosure includes a method for mixing a plurality of particles dispersed within a liquid media via a mixing tank; applying a swirling effect to the plurality of particles in the mixing tank via a vane unit; launching a plurality of droplets via a spray nozzle in operable communication with the vane unit, the plurality of droplets including different combinations of the plurality of particles; and providing a plurality of outlet ports, where two outlet ports include filters capable of receiving a plurality of droplets falling outside a predetermined size range, wherein the other outlet port is filterless capable of receiving a plurality of droplets falling within a predetermined size range, and wherein the swirling effect generated by the vane unit causes the separation of the plurality of droplets to be received by the plurality of outlet ports.

In other embodiments a process of the present disclosure includes a method for forming particles including a resin, an optional colorant, and an optional wax; mixing a plurality of particles dispersed within a liquid media via a mixing tank; launching a plurality of droplets via a spray nozzle in operable communication with the vane unit, the plurality of droplets including different combinations of the plurality of particles; applying a swirling effect to the plurality of particles in the mixing tank via a vane unit; and providing a plurality of outlet ports, where each of a first set of outlet ports includes a filter capable of receiving a plurality of droplets falling outside a predetermined size range, wherein the other outlet port is filterless capable of receiving a plurality of droplets falling within a predetermined size range, and wherein the swirling effect generated by the vane unit causes the separation of the plurality of droplets to be received by the plurality of outlet ports.

BRIEF DESCRIPTION OF THE DRAWINGS

Various embodiments of the present disclosure will be described herein below with reference to the figures wherein.

DETAILED DESCRIPTION

Figure 1:
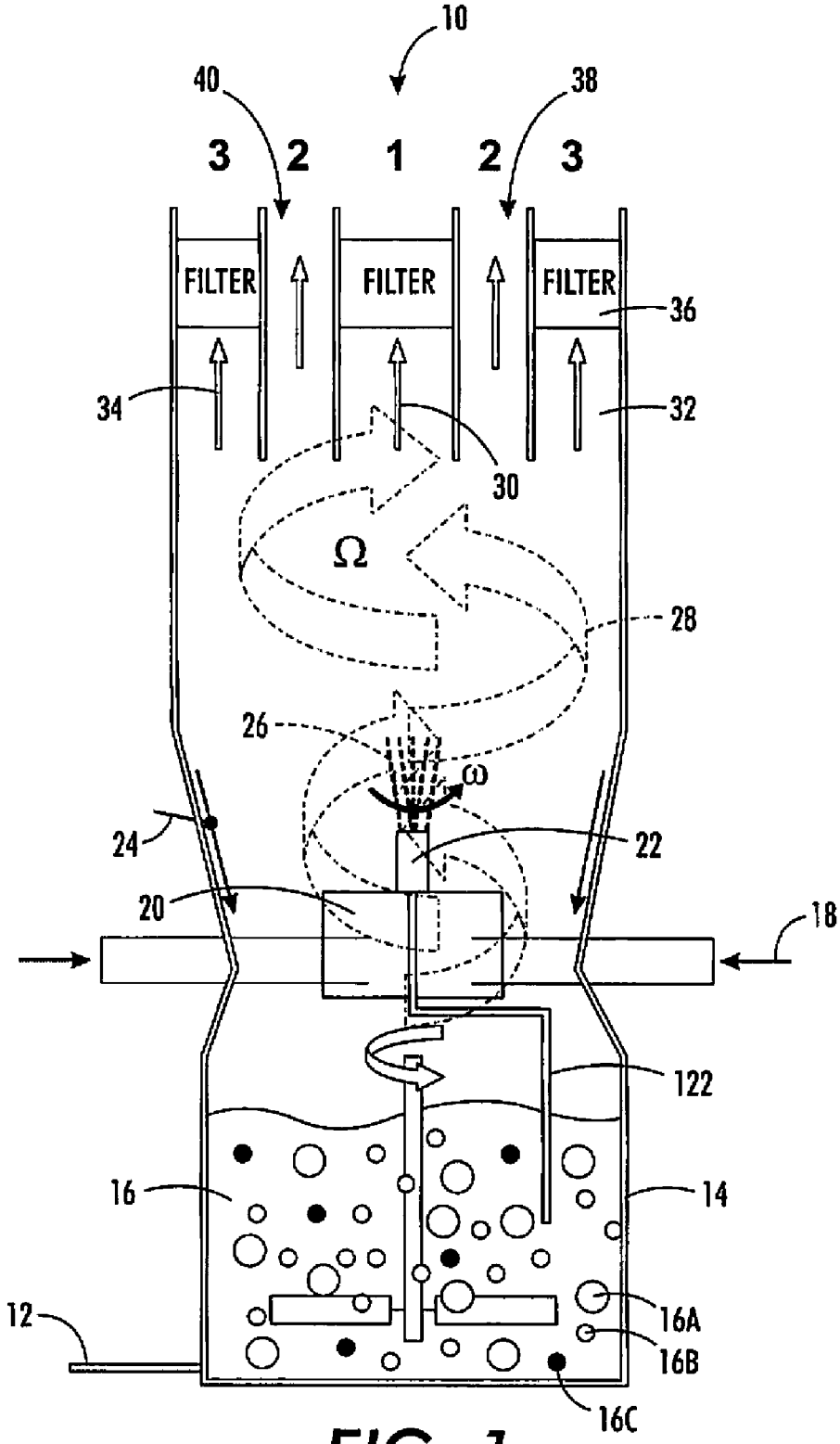
FIG. 1 is a schematic diagram of a chemical toner production process that utilizes a spray drying process, in accordance with the present disclosure.

The present disclosure proposes a method and apparatus for a low-cost, rapid continuous process for chemical toner production. The process uses spray drying to force aggregates of primary or intermediate particles into a desired-sized particle product. The process is efficient and rapid, and therefore can reduce the toner manufacturing cost and increase a toner plant's throughput.

Resins

Any toner resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

In embodiments, the resin may be a polyester, polyimide, polyolefin, polyamide, polycarbonate, epoxy resin, and/or copolymers thereof. In embodiments, the resin may be an amorphous resin, a crystalline resin, and/or a mixture of crystalline and amorphous resins. The crystalline resin may be present in the mixture of crystalline and amorphous resins, for example, in an amount of from 0 to about 50 percent by weight of the total toner resin, in embodiments from 5 to about 35 percent by weight of the toner resin. The amorphous resin may be present in the mixture, for example, in an amount of from about 50 to about 100 percent by weight of the total toner resin, in embodiments from about 65 to about 95 percent by weight of the toner resin. In embodiments, the resin may be a polyester crystalline and/or a polyester amorphous resin.

In embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a dial with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate). The crystalline resin may be present, for example, in an amount of from about 5 to about 50 percent by weight of the toner components, in embodiments from about 10 to about 35 percent by weight of the toner components.

The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo -isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

The amorphous resin can possess various glass transition temperatures (Tg) of, for example, from about 40° C. to about 100° C., in embodiments from about 50° C. to about 70° C. The crystalline resin may have a number average molecular weight ($M_n$), for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography (GPC) using polystyrene standards. The molecular weight distribution ($M_w/M_n$) of the crystalline resin may be, for example, from about 2 to about 6, in embodiments from about 3 to about 4.

In embodiments, a suitable amorphous polyester resin may be a poly(propoxylated bisphenol A co-fumarate) resin having the following formula (I):

(I)

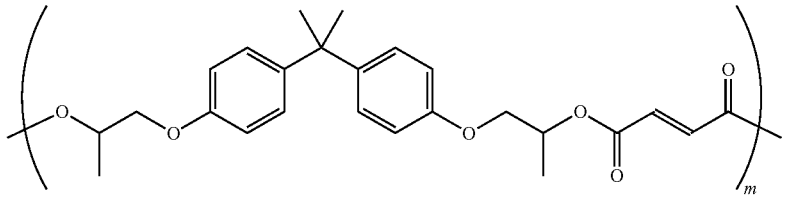

wherein m may be from about 5 to about 1000, in embodiments from about 10 to about 500, in other embodiments from about 15 to about 200. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a toner resin is available under the trade name SPARII from Resana S/A Industrias Quimicas, Sao Paulo, Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

(II)

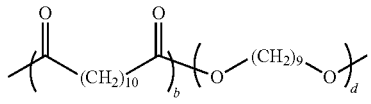

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a resin suitable for forming a toner.

Examples of other suitable toner resins or polymers which may be utilized include those based upon styrenes, acrylates, methacrylates, butadienes, isoprenes, acrylic acids, methacrylic acids, acrylonitriles, and combinations thereof. Exemplary additional resins or polymers include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In embodiments, the resins may include polyester resins having a glass transition temperature of from about 30° C. to about 80° C., in embodiments from about 35° C. to about 70° C. In further embodiments, the resins utilized in the toner may have a melt viscosity of from about 10 to about 1,000,000 Pa*S at about 130° C., in embodiments from about 20 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, in embodiments from about 75 to about 85 percent by weight of the toner particles (that is, toner particles exclusive of external additives) on a solids basis. Where the resin is a combination of a crystalline resin and an amorphous resin, the ratio of crystalline resin to amorphous resin can be in embodiments from about 1:99 to about 30:70, in embodiments from about 5:95 to about 25:75, in some embodiments from about 5:95 to about 15:95.

Toner

The resin described above may be utilized to form toner compositions. Such toner compositions may include optional colorants, waxes, and other additives. Toners may be formed utilizing any method within the purview of those skilled in the art. For example, a specific chemical toner production process that utilizes spray drying is presented below.

Surfactants

In embodiments, resins, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of those skilled in the art. Although embodiments relating to toner particle production are described below with respect to emulsion processes and a specific chemical toner production process that utilizes spray drying, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion aggregation processes, such as a process that includes combining a mixture of an optional colorant, an optional wax and any other desired or required additives, and emulsions including the resins described above, optionally in surfactants as described above, and then coalescing the particulate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an optional aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides, polyaluminum silicates, and water soluble metal salts. The growth and shaping of the particles following addition of the optional aggregation agent may be accomplished under any suitable conditions.

Chemical Toner Production Using Spray Drying

In embodiments, the present disclosure provides a continuous chemical toner production process that utilizes spray drying to force aggregation of the primary (or intermediate) particles into desired-sized or predetermined-sized particle products. The proposed process is schematically shown in FIGS. 1 and 2 described below.

Figure 2:
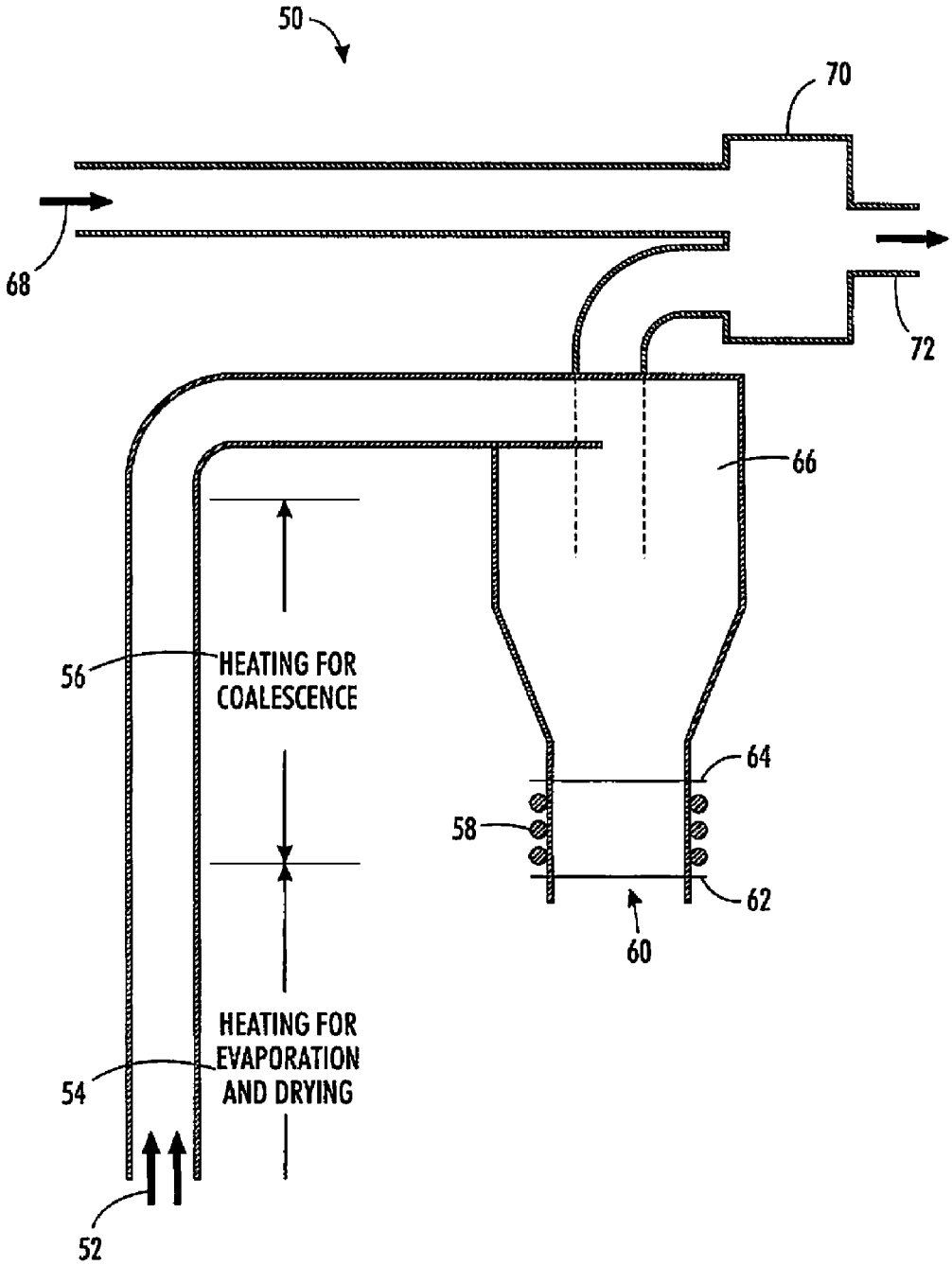
FIG. 2 is a schematic diagram of heating and separation sections of the chemical toner production process of FIG. 1, in accordance with the present disclosure.

FIG. 1 is a schematic diagram of a chemical toner production process that utilizes a spray drying process, in accordance with the present disclosure.

The schematic diagram 10 includes a materials feed 12, a mixing tank 14, particles 16, an air inlet port 18, a vane unit 20, a spray nozzle 22, liquid film formed by large droplets 24, droplets 26, a swirling flow (or effect) 28, small droplet air flow 30, a first big droplet air flow 32, and a second big droplet air flow 34, where 32 and 34 are the same air flow because the system is axially symmetric. Also, the air flow 32 and 34 are parts of an annular air stream. Additionally, schematic 10 includes filters 36, a first airflow carrying correct droplets 38 and a second airflow carrying correct droplets 40. Once again, 38 and 40 are parts of same annular air stream. Air flows 30, 32, 34, 38, and 40 may be referred to as outlet ports. Outlet ports 30, 32, 34 may be referred to as a first set of outlet ports having filters 36 and 39 (central filter), whereas outlet ports 38, 40 may be referred to as a second set of outlet ports being filterless. Filters 36 and 39 filter out the droplets from the air flows.

Furthermore, the particles 16 are of different sizes in FIG. 1 because they represent different types of particles. For example, latex particles 16A, pigment particles 16B, and wax particles 16C are shown, where the latex particles 16A are bigger than the pigment particles 16B and wax particles 16C.

FIG. 2 is a schematic diagram of heating and separation sections of the chemical toner production process of FIG. 1, in accordance with the present disclosure.

The schematic diagram 50 includes a first passage 52 for passage of the first airflow 38 carrying correct droplets and the second airflow 40 carrying correct droplets. The first passage 52 is divided into a first section 54 for heating for evaporation and drying and a second section 56 for heating for coalescence. The schematic diagram 50 further includes a cyclone separator 66 having cooling coils 58 and a finished toner product 60 positioned between the first door 62 and the second door 64. A second passage 68 for passage of the air flow 30, the air flow 32, and air flow 34 is connected to a chamber 70 for combining air flows 30, 32, 34, 38, and 40 to a final air flow 72 to a vacuum blower (not shown).

In schematic diagram 10 of FIG. 1, the system is maintained at a pressure lower than that of the ambient condition (i.e., kept in a low-level vacuum state, for example, from about 0 Torr to about −600 Torr, in embodiments from about −10 Torr to about −250 Torr, in other embodiments from about from about −20 Torr to about −120 Torr). This desired pressure set point of the system can be achieved through a proper balance between the vacuum blower (not shown) and the openings of air inlet 18 shown in FIG. 1.

The system further includes a mixing tank 14 that agitates the suspension and maintains the liquid media homogeneous and the dispersed particles 16 within well-mixed and well-dispersed. Ideally, the liquid suspension inside the mixing tank 14 would contain a higher solids content (latex, pigments, wax, etc.) than that in conventional EA toner processes (e.g., from about 16% solids to about 35% solids). The material can be kept at an elevated temperature (e.g., from about 30° C. to about 50° C.). The mixing tank 14 can be separated from the spray nozzle 22 so that the pressure drop in the spray 26 and swirling flow 28 area would not affect the latex suspension.

A pump pressurizes this liquid suspension through the spray nozzle 22 which atomizes the liquid into small angle spray of droplets 26 and launches them into the core region of a strong swirling air flow 28 (e.g., of angular velocity $\Omega$) along the axial direction of swirling air flow 28. If desired, a spinning nozzle can be used for launching the droplets 26 with an angular velocity $\omega$ into the swirling air flow 28. It is noted that methods other than a spin nozzle may also be utilized.

It is known that the droplets 26 from the spray nozzle 22 come with a size distribution. Depending on the type of nozzle and the system designs, some nozzles generate narrower size distribution than others (e.g., some designs have utilized piezo-electrically activated nozzles to produce small size distributions). Nevertheless, the size of droplets 26 in a spray typically can be regarded as non-uniform. The spinning of spray nozzle 22 and the swirling of air flow 28 provide the added functions of size selection (i.e., assisting the size classification/selection, and helping producing even narrower droplet size distribution). This is because when a spray of droplets 26 is placed at the core region of a strong swirling flow 28, the droplets 26 are segregated by their sizes. The bigger droplets tend to migrate away from the swirl center faster than the smaller ones. This result can be used for size classification of the droplets.

Moreover, droplets 26 of a size outside the desired or predetermined range (i.e., too large or too small) are immediately filtered out from the air streams (see 1 and 3 in FIG. 1) by appropriate filters 36. The filters 36 can be cooled for more effective droplet recovery. The material recovered by the filters 36 is fed back to the mixing tank 14 and is not wasted. Some large droplets may also impact and deposit on the wall of the swirling flow chamber, and form a liquid film 24 that flows back to the mixing tank 14. The wall of the chamber can be cooled to enhance mist recovery.

The droplets 26 of selected and narrowly distributed size would statistically contain an equal number of particles (of latex, pigments, wax, additives, etc.) The air flow 28 carrying droplets of correct size 38, 40 is guided to heating sections (see 54 and 56 of FIG. 2), sometimes referred to herein, in embodiments, as a first heating unit and a second heating unit, respectively, where the droplets 26 are first heated by the first heating unit (e.g., from about 50° C. to about 100° C.) to evaporate the carrier liquid medium (e.g., in the current EA process, water) and then heated by the second heating unit (from about 60° C. to about 150° C.) with hot air injection, for example, for the particulate content (i.e., the aggregates) to coalesce into chemical toner particles possessing the final morphology.

During the drying and heating process, the droplet loading in the air stream 52 can be kept small, in embodiments as a dilute suspension, to minimize the collisions between the droplets. The heating process does not have to be separated in two different steps. An alternative can be a path of gradually increased temperature. If necessary, the mixing tank 14, the pipeline 122 to the spray nozzle, and the pipeline 122 can also be heated to an elevated temperature (from about 50° C. to about 80° C.) to facilitate the droplet drying process. Also, these droplets are downstream at 52 in FIG. 2. It should be emphasized that, in evaporation and drying, the volume of droplets shrinks. The surface tension of droplets help compact the particulate content (e.g., latex, pigments, wax, additives, etc.) in the droplets into a compact aggregate. Once again, these droplets are downstream at 52 in FIG. 2.

In embodiments, the present disclosure may be utilized for size classification of droplets 26 sprayed into the core of the swirling air flow 28. For example, one may examine the flow 28 and the particle motions from a rotating frame of reference that rotates with the angular velocity of the flow swirling, Ω. It should be noted that, since a rotating frame of reference is not an inertial frame, an apparent force due to "Coriolis acceleration," in addition to those due to the centrifugal and the tangential accelerations, also acts on the droplets 26. It is believed, however, that the main mechanism for droplet segregation is due to the balance between the centrifugal force and the viscous force acting on the droplets 26.

Ideally, the droplets 26 are launched into the core of the swirling flow 28 with an angular velocity ω closely-matching that of the swirl. Since the droplets 26 are placed with an angular velocity ω at the core region of the swirling air flow 28 (of angular velocity Ω), for the case of closely matched angular velocities $\omega \approx \Omega$, the angular motions of the droplets 26 quickly settle to and follow that of the air flow 28. For small droplets, with small relaxation time, the swirling flow 28 can quickly drive up the angular motion of the droplets, and the spray does not need to be launched with an initial angular velocity. In embodiments, where the angular velocity of the droplets launched from the spray nozzle is close to the angular velocity of the swirling flow, the angular velocity may be from about 20 to about 500 rad/min, in embodiments from about 30 to about 400 rad/min, in other embodiments from about 40 to about 300 rad/min. The angular velocity is also dependent on the diameter of the diameter of swirling head (22), the location of air flow exits (38 and 40 in FIG. 1), and the height between the exits (38 and 40) and the swirling head (22).

In other embodiments, the angular velocity of the droplets launched from the spray nozzle may be different than the angular velocity of the swirling flow. In such a case, the angular velocity of the droplets may be from about 0 to about 600, in embodiments from about 50 to about 400, in other embodiments from about 100 to about 300.

For radial motions, the droplets 26 migrate away from the core of the swirling flow 28 due to the centrifugal forces that act on them. This force is given by the equation:

$$m_d R \Omega^2$$

where $m_d$ is the mass of the droplet, R is the distance of the droplet from the axis of the swirl, and Ω is the angular velocity of the swirl 28.

For small droplets 26, one can assume spherical shape and a linear drag law of:

$$6\pi r_d \eta V$$

where $r_d$ is the droplet radius, η is the viscosity of the air, and V is the radial migrating velocity.

Due to small droplet sizes, the centrifugal force acting on each of the droplets 26 is quickly balanced out by the drag force, and the migrating velocities of the droplets 26 settle to the terminal velocities, which are given as:

$$V_{terminal} = \frac{2\rho_d r_d^2 R \Omega^2}{9\eta}.$$

where $\rho_d$ is the density of the droplets 26. As can be seen from the above equation, the radial migrating velocity of the droplets 26 is proportional to $r_d^2$. That is, the larger droplets migrate outward faster than the smaller ones, and this speed difference increases as the droplets move away from the swirl 28 center (larger R). The preciseness of the size selection process can be fine-tuned with the correct type of spray nozzle 22, the strength and the flow structure of the swirling air flow 28, and the size-selecting channels/vanes located at the upper part of the swirling flow 28.

Particles

In evaporation and drying, the volume of the droplet shrinks. The surface tension of the droplet helps compacting the particulate content (e.g., latex, pigments, wax, additives, etc.) in the droplet into a compact aggregate. This forced aggregation process is different from the process in current EA manufacturing. This proposed new process is efficient and fast and therefore can reduce the toner manufacturing cost and increase a toner plant's throughput (i.e., green manufacturing).

Shell Resin

In embodiments, prior to or after the coalescence, the formed aggregates/particles can also be coated with an outer/shell layer for desired functionalities. Resins which may be utilized to form the shell include, but are not limited to, the amorphous resins described above for use in the core.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy)diisopropyl benzene, di-t-butyl peroxide and 2,5-dimethyl 2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy)3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy)

butyrate, and combinations thereof. Examples of suitable azo compounds include 2,2,'-azobis(2,4-dimethylpentane nitrile), azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time of from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, in embodiments, a first polyester resin may be combined with other resins to form a shell. Multiple resins may be utilized in any suitable amounts. In embodiments, a first amorphous polyester resin may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

Coalescence

Following aggregation to the desired particle size and application of an optional shell resin described above, the particles may then be coalesced to the desired final shape. The air flow carrying droplets of correct size (indicated as 2 in FIG. 2) is guided to a heating section where the droplets are first heated (from about 50° C. to about 100° C.) to evaporate the carrier liquid medium (in embodiments, water) and then heated (from about 60° C. to about 150° C.) with hot air injection, for example, for the particulate content (i.e., the aggregates) to coalescence into the final morphology. During the drying and heating process, the droplet loading in the air stream can be kept small, in embodiments as a dilute suspension, to minimize the possible collisions between the droplets. The heating process does not have to be separated in two different steps. An alternative can be a path of gradually increased temperature. This temperature may, in embodiments, be from about 40° C. to about 99° C., in embodiments from about 50° C. to about 95° C. Higher or lower temperatures may be used, it being understood that the temperature is a function of the resins used.

After the heating for coalescence, the air flow (now carrying finished toner particles) enters a cyclone separator (or a bag-house filtering system) where the toner particles are separated from the air. The cyclone separator is equipped with a double-door lock that helps maintain a vacuum in the system. The finished toner product at the bottom of the cyclone separator is then cooled to room temperature. The device of the present disclosure can be used not only for EA toner production, but also for the production of other nano-composite particles. For example, it can be used to coat gold nano-particles with polymers.

Additives

In embodiments, the toner particles may also contain other optional additives, as desired or required. For example, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, 6,214,507, and 7,452,646 the disclosures of each of which are hereby incorporated by reference in their entirety. Again, these additives may be applied simultaneously with the shell resin described above or after application of the shell resin.

Additives may be combined with the toner particles as part of a dispersion; in embodiments such additives in a dispersion may be referred to as a particle dispersion. In embodiments such a particle dispersion may be an aqueous dispersion and may include electronically conductive or semiconductive particles.

In embodiments, toners of the present disclosure may be utilized as ultra low melt (ULM) toners. In embodiments, the dry toner particles having a shell of the present disclosure may, exclusive of external surface additives, have the following characteristics:

(1) Volume average diameter (also referred to as "volume average particle diameter") of from about 50 nm to about 100 microns, in embodiments from about 100 nm to about 50 microns, in other embodiments from about 500 nm to about 25 microns.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.93 to about 1, in embodiments from about 0.95 to about 0.99 (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH.

Developers

The toner particles thus obtained may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments; PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic or xerographic processes, including those disclosed in U.S. Pat. No. 4,265,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a development component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

The present disclosure describes a method and apparatus of a low-cost, rapid continuous process for chemical toner production. The proposed method eliminates the traditional aggregation process associated with chemical/EA toner production. Instead, the present disclosure uses spray drying to force aggregation of primaries (or intermediates) to form desired-sized particles. The proposed method may also utilize rotational spray (produced with spinning nozzle or other methods) and swirling air flow for particle size selection/classification. The process is efficient and can reduce the toner manufacturing cost and increase a toner plant's throughput. The process has high efficiency and results in a more economical process.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for chemical toner production comprising:

a mixing tank for mixing a plurality of particles, wherein the plurality of particles comprises one or more of a resin, a wax, and a pigment, and wherein the plurality of particles are dispersed within a liquid media thereby forming a particle dispersion;

a vane unit for applying a swirling effect to the plurality of particles in the mixing tank;

a spray nozzle in operable communication with the vane unit for launching a plurality of droplets, the plurality of droplets composed of different combinations of the plurality of particles; and three outlet ports, a first outlet port being circular and having a filter, a second outlet port being annular without a filter, and a third outlet port being annular and having a filter;

wherein the swirling effect generated by the vane unit causes the plurality of droplets to be received by the three outlet ports in different sizes.

2. The system of claim 1, wherein toner particles produced by the system are from 50 nm to 100 microns in diameter.

3. The system of claim 1, wherein the mixing tank maintains the liquid media in a homogeneous state having a solids content of from about 16% solids to about 35% solids and wherein the plurality of particles in the mixing tank are maintained at a temperature of from about 30° C. to about 50° C.

4. The system of claim 1, wherein the plurality of droplets are launched from the spray nozzle with an angular velocity of from about 30 to about 400 rad/min.

5. The system of claim 1, wherein the particle dispersion comprises an aqueous dispersion including electrically conductive or semiconductive particles.

6. The system of claim 1, wherein the outlet ports including the filters receive the plurality of droplets falling outside a predetermined size range, and wherein the outlet port being filterless receives the plurality of droplets falling within the predetermined size range.

7. The system of claim 6, wherein the filters of outlet ports are cooled to allow the plurality of droplets falling outside the predetermined size range to return back into the mixing tank.

8. The system of claim 6, wherein the plurality of droplets received via the filterless outlet port falling within the predetermined size range are transported through a heating unit for evaporating a carrier liquid medium and coalescing the plurality of droplets into toner particles.

* * * * *